US009252506B2

(12) United States Patent
Acera

(10) Patent No.: US 9,252,506 B2
(45) Date of Patent: Feb. 2, 2016

(54) ELECTRICAL CONNECTOR WITH A WIRE ORGANIZATION BASE

(71) Applicant: Amphenol LTW Technology Co., Ltd., New Taipei (TW)

(72) Inventor: Jimmy Enrique Acera, New Taipei (TW)

(73) Assignee: AMPHENOL LTW TECHNOLOGY CO., LTD., New Taipei (TW)

( * ) Notice: Subject to any disclaimer, the term of this patent is extended or adjusted under 35 U.S.C. 154(b) by 100 days.

(21) Appl. No.: 14/276,977

(22) Filed: May 13, 2014

(65) Prior Publication Data

US 2015/0214638 A1 Jul. 30, 2015

(30) Foreign Application Priority Data

Jan. 29, 2014 (TW) ..... 103202015 U

(51) Int. Cl.

| | |
|---|---|
| ***H01R 4/24*** | (2006.01) |
| ***H01R 4/26*** | (2006.01) |
| ***H01R 11/20*** | (2006.01) |
| ***H01R 24/20*** | (2011.01) |

(52) U.S. Cl.

CPC ..... *H01R 4/2429* (2013.01); *H01R 4/2416* (2013.01); *H01R 24/20* (2013.01)

(58) Field of Classification Search

CPC .. H01R 4/2433; H01R 4/2429; H01R 4/2491; H01R 13/622

USPC ..... 439/404, 417, 393, 320, 395, 398

See application file for complete search history.

(56) References Cited

U.S. PATENT DOCUMENTS

| | | | | | |
|---|---|---|---|---|---|
| 4,053,197 | A * | 10/1977 | Teagno | H01R 4/2491 | 439/404 |
| 4,066,316 | A * | 1/1978 | Rollings | H01R 4/2433 | 439/404 |
| 4,405,193 | A * | 9/1983 | Weidler | H01R 4/2445 | 439/398 |
| 4,960,388 | A * | 10/1990 | Frantz | H01R 13/648 | 439/404 |
| 4,960,389 | A | 10/1990 | Frantz et al. | | |
| 4,969,839 | A * | 11/1990 | Nilsson | H01R 4/2429 | 439/395 |

(Continued)

FOREIGN PATENT DOCUMENTS

EP 2608326 A1 6/2013

OTHER PUBLICATIONS

Search Report dated Jul. 16, 2014 of the corresponding European patent application No. 14169269.9.

*Primary Examiner* — Hae Moon Hyeon

(74) *Attorney, Agent, or Firm* — Chun-Ming Shih; HDLS IPR Services

(57) ABSTRACT

An electrical connector includes an insulative column housing (100) having a wire connection base (110) with a receiving slot (111) formed at a rear thereof; a plurality of terminals (200) embedded inside the insulative column housing (100) and having a piercing cutter (210) on one end thereof respectively to penetrate into the receiving slot (111) along an axial direction of the insulative column housing (100); and a wire organization base 300 penetrating into the receiving slot (111) along the axial direction of the insulative column housing (100) and having a plurality of wire plug-in slots (310) corresponding to the piercing cutters (210) such that the wire plug-in slots (310) arranged perpendicular to the piercing cutters (210) corresponding. Accordingly, the wire organization base (300) clamps and secures the wires (11) therein in advance to allow the wires (11) to electrically connect to the corresponding terminals (200).

10 Claims, 10 Drawing Sheets

(56) References Cited

U.S. PATENT DOCUMENTS 5,305,547 A * 4/1994 Weiss ..... H01R 4/2433 439/395
5,599,202 A * 2/1997 Key ..... H01R 13/502 439/395
5,662,492 A * 9/1997 Weiss ..... H01R 13/652 439/404
5,915,990 A * 6/1999 Beer ..... H01R 12/675 439/404
6,203,360 B1 * 3/2001 Harting ..... H01R 4/2433 439/395
6,267,617 B1 * 7/2001 Nozick ..... H01R 4/2433 439/404
6,280,229 B1 * 8/2001 Harting ..... H01R 4/2433 439/320
6,371,793 B1 * 4/2002 Doorhy ..... H01R 13/6469 439/404
6,544,067 B2 * 4/2003 Hagmann ..... H01R 4/2429 439/395
6,890,210 B2 * 5/2005 Lee ..... H01R 4/2454 439/397
8,460,024 B2 * 6/2013 Damodharan ..... H01R 4/2433 439/395
8,814,589 B2 * 8/2014 Chien ..... H01R 4/2433 439/393
2009/0318011 A1 12/2009 Farahani
2012/0058667 A1 3/2012 Carreras et al.
2013/0323962 A1 * 12/2013 Chien ..... H01R 4/2433 439/393
2015/0214637 A1 * 7/2015 Acera ..... H01R 4/2416 439/404
2015/0280331 A1 * 10/2015 Acera ..... H01R 4/2433 439/395

* cited by examiner

ELECTRICAL CONNECTOR WITH A WIRE ORGANIZATION BASE

BACKGROUND OF THE INVENTION

1. Field of the Invention

The present invention is related to an electrical connector, in particular to a piercing electrical connector.

2. Description of Related Art

A conventional electrical connector electrically connected to a circuit board or a wire is typically achieved by a soldering connection method in order to be connected to the circuit board. The most common connection method adapted between the connected wires is, in fact, either with a soldering connection or a piercing connection. For the piercing connection, the terminal of the electrical connector is formed of a piercing cutter such that the piercing cutter is capable of piercing through the outer skin of the wire correspondingly in the associated connecting wires.

The drawback of such known technique has to do with the manual alignment of the piercing cutter required prior to the connection of the wires as well as the necessary use of a fixture for pressing the wires onto the piercing cutter. However, the manual alignment can be time consuming and tends to cause errors during the alignment, which not only slows down the assembly process but also results in poor yield rate for the assembly.

In view of the above, the inventor seeks to provide a novel solution to overcome the aforementioned drawbacks associated with the known arts along with years of experience and application of theoretical principles in the field.

SUMMARY OF THE INVENTION

An objective of the present invention is to provide an electrical connector capable of facilitating wire connections thereon.

To achieve the aforementioned objective, the present invention provides an electrical connector comprising an insulative column housing, a plurality of terminals and a wire organization base. The insulative column housing includes a wire connection base provided at one end thereof; an end portion of the wire connection base includes a receiving slot formed thereon along an axial direction of the insulative column housing. The terminals are embedded inside the insulative column housing; each one of the terminals includes a piercing cutter provided at one end thereof; the piercing cutter extends along the axial direction of the insulative column housing and penetrates into the receiving slot. The wire organization base penetrates into the receiving slot along the axial direction of the insulative column housing and includes a plurality of wire plug-in slots corresponding to the plurality of piercing cutters respectively; each one of the plurality of wire plug-in slots and the plurality of piercing cutters corresponding thereto are arranged to be perpendicular with each other.

According to the aforementioned electrical connector, each one of the plurality of wire plug-in slots includes a positioning hole provided to allow the corresponding piercing cutter to penetrate therethrough.

According to the aforementioned electrical connector, the wire connection base includes an opening formed on one side thereof and connected to the receiving slot; the wire organization base includes a wire plug-in surface provided to allow one end of each one of the wire plug-in slots to connect to the wire plug-in surface such that the wire plug-in surface passes through the opening to be exposed on the wire connection base.

According to the aforementioned electrical connector, the receiving slot includes a pair of first guiding structures arranged opposite from each other at an inner wall thereof; the wire organization base includes a pair of second guiding structures arranged opposite from each other at an outer wall thereof and corresponding to the pair of first guiding structures respectively; the pair of first guiding structures are slidably connected to the pair of second guiding structures correspondingly.

According to the aforementioned electrical connector, each one of the pair of first guiding structures comprises a guiding track indented into the inner wall of the receiving slot and extended along the axial direction of the insulative column housing; each one of the pair of second guiding structures comprises a guiding rib correspondingly and slidably connected to the guiding track.

According to the aforementioned electrical connector, each one of the pair of first guiding structures comprises a guiding rib protruding from the inner wall of the receiving slot and extended along the axial direction of the insulative column housing; each one of the pair of second guiding structures comprises a guiding track correspondingly and slidably connected to the guiding rib.

According to the aforementioned electrical connector, the insulative column housing includes a connection plug head formed on another end thereof; the connection plug head includes a plurality of perforations formed at an axial direction thereof and corresponding to the plurality of terminals; each one of the plurality of terminals penetrates into each one of the plurality of perforations correspondingly with another end thereof.

According to the aforementioned electrical connector, it further comprises a tubular outer casing covering the insulative column housing; the tubular outer casing includes a threaded portion circumferencing an outer lateral surface on one end thereof and corresponding to a position of the connection plug head.

According to the aforementioned electrical connector, the tubular outer casing comprises a first casing member and a second casing member attached to each other along an axial direction thereof; the first casing member covers the connection plug head and the second casing member covers the wire connection base.

According to the aforementioned electrical connector, the threaded portion is provided at an outer lateral surface of the first casing member.

According to the aforementioned electrical connector, the second casing member includes a wire connection opening formed thereon.

The electrical connector of the present invention is able to utilize the wire organization base for clamping the wires in advance in order to assist the plug-in of the wires; therefore, the wires can be electrically connected to the corresponding terminals with ease.

DETAILED DESCRIPTION OF THE INVENTION

Figure 1:
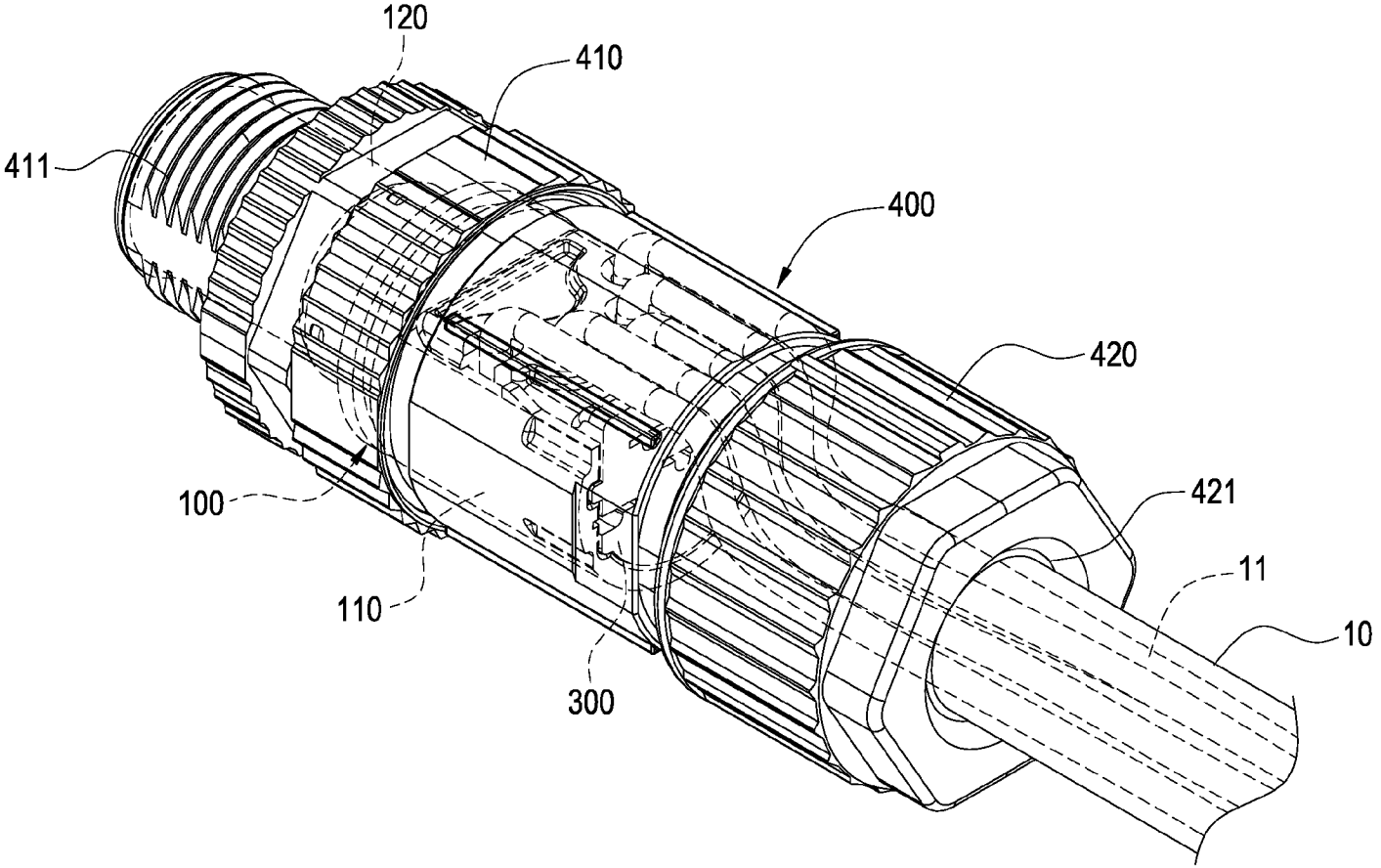
FIG. 1 is a perspective view of an electrical connector of a preferred embodiment of the present invention.
Figure 2:
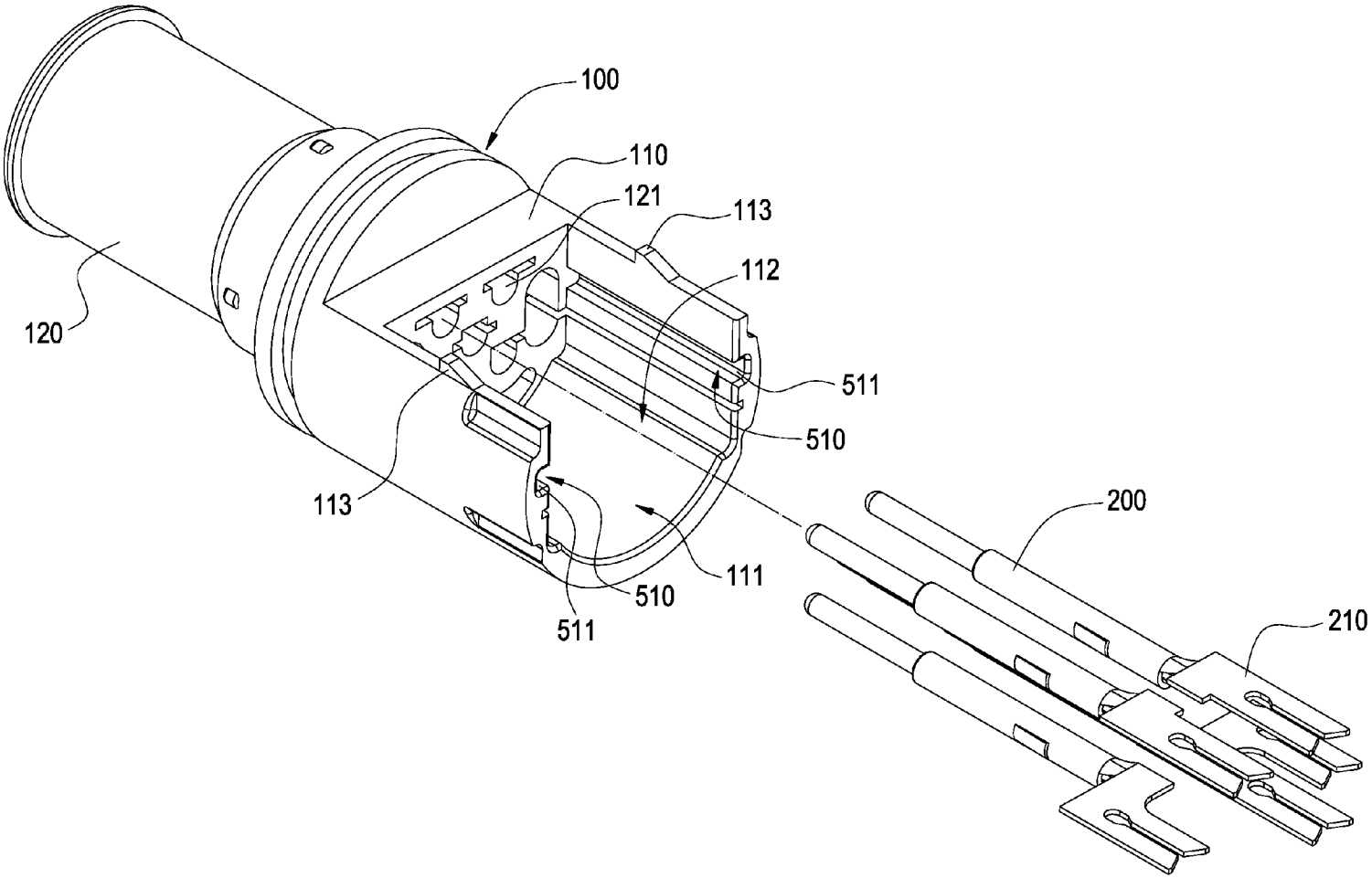
FIG. 2 is an illustration showing the insulative column housing and the terminals of the electrical connector according to a preferred embodiment of the present invention.

As shown in FIG. 1 and FIG. 2, according to a preferred embodiment of the present invention, an electrical connector comprises an insulative column housing 100, a plurality of terminals 200, a wire organization base 300 and a tubular outer casing 400.

In this embodiment of the present invention, the insulative column housing 100 is made of a plastic material. The insulative column housing 100 includes a wire connection base 110 formed on one end thereof and a connection plug head 120 formed on another end thereof. A rear end surface of the wire connection base 110 includes a receiving slot 111 formed thereon and extended along an axial direction of the insulative column housing 100. In addition, one lateral surface of the wire connection base 110 also includes an opening 112 connected to the receiving slot 111, and an outer side of the wire connection base 110 further includes at least one first blocking member 113 (in this embodiment, two of the first blocking members 113 are provided). The connection plug head 120 is of a circular column shape and includes a plurality of perforations 121 formed at a rear end surface along an axial direction thereof; in this embodiment, five perforations 121 are provided on the connection plug head 120.

According to an embodiment of the present invention, the electrical connector comprises five terminals 200 made of a metal material. Each one of the terminals 200 is of an elongated shape; in addition, the terminals 200 are embedded inside the insulative column housing 100, and the terminals 200 are arranged corresponding to the perforations 121 respectively. One end of each one of the terminals 200 is of a hollow column shape and penetrates into each one of the perforations 121 correspondingly, whereas another end of each one of the terminals 200 includes a piercing cutter 210 extended outward along an axial direction thereof. The piercing cutters 210 extend along the axial direction of the insulative column housing 100 to penetrate into the receiving slot 111 of the wire connection base 110 respectively. In this embodiment, each one of the piercing cutters 210 is a piercing clamp; however, the present invention is not limited to such type of piercing cutter only.

Figure 3:
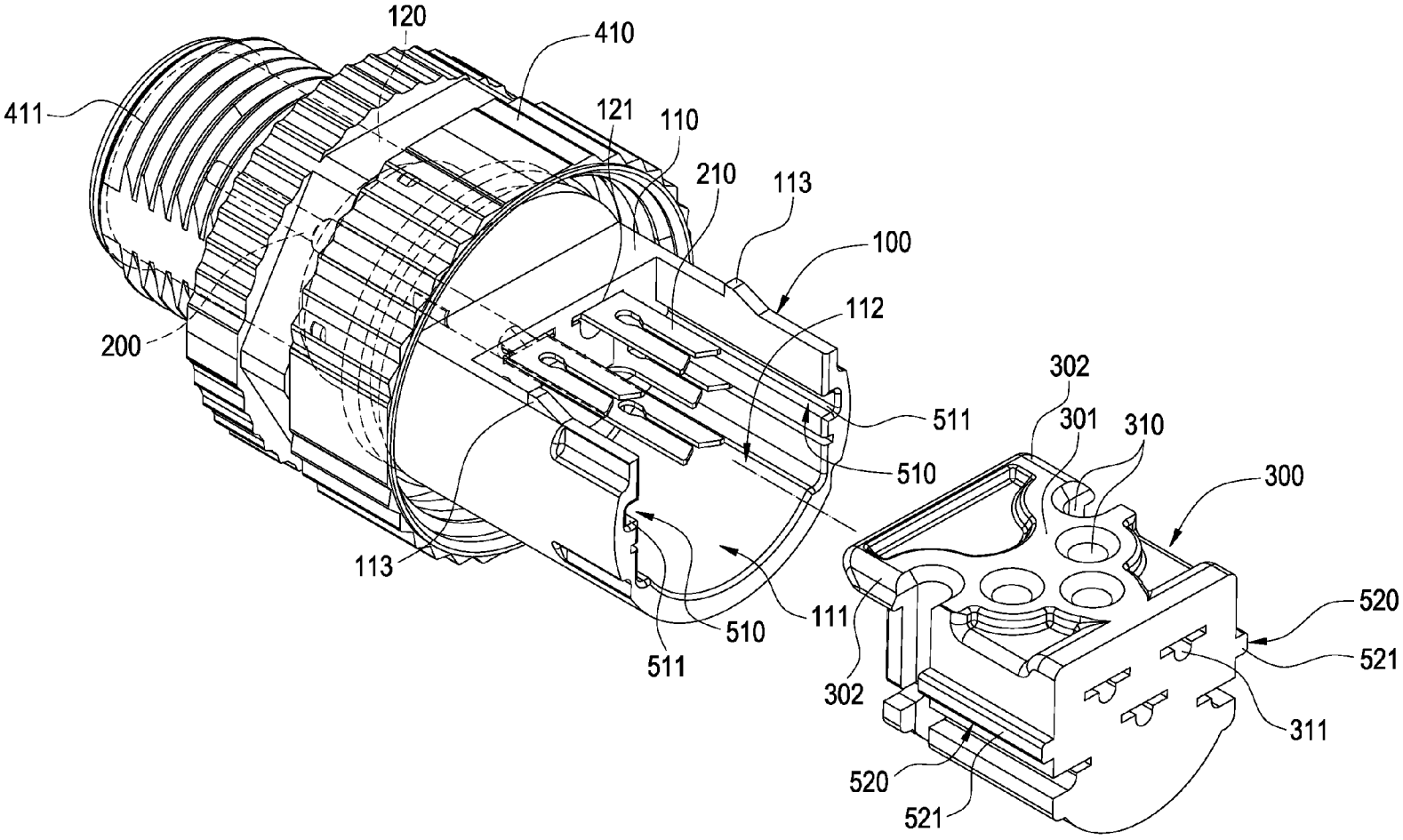
FIG. 3 is an exploded view of an electrical connector according to a preferred embodiment of the present invention.

Please refer to FIG. 3. The wire organization base 300 penetrates into the receiving slot 111 along the axial direction of the insulative column housing 100. In this embodiment, the wire organization base 300 includes a wire plug-in surface 301, and the wire plug-in surface 301 includes a plurality of wire plug-in slots 310 arranged corresponding to the positions of the plurality of piercing cutters 210 respectively. Each one of the wire plug-in slots 310 preferably extends into the wire organization base 300 and is arranged perpendicular to the corresponding piercing cutter 210 with each other. A positioning hole 311 is formed inside each one of the wire plug-in slots 310 aligned with the corresponding piercing cutter 210, and the positioning hole 311 penetrates through the outer surface of the wire organization base 300. The outer side of the wire organization base 300 further includes second blocking members 302 corresponding to the first blocking members 113 respectively.

The receiving slot 111 of the wire connection base 110 includes a pair of first guiding structures 510 arranged opposite from each other at an inner wall thereof. In this embodiment, each one of the pair of first guiding structures 510 comprises a guiding slot 511 indented into the inner wall of the receiving slot 111 and extended along the axial direction of the insulative column housing 100. The wire organization base 300 includes a pair of second guiding structures 520 arranged opposite from each other at an outer wall thereof and corresponding to the pair of first guiding structures 510 respectively. In this embodiment, each one of the pair of second guiding structures 520 comprises a guiding rib 521 corresponding to each one of the guiding slots. In addition, each one of the guiding slots 511 is slidably connected to the corresponding guiding rib 521. However, the present invention is not limited to such configuration only. For example, in another embodiment, the first guiding structures 510 can also comprise guiding ribs protruding from the inner wall of the receiving slot 111 and extended along the axial direction of the insulative column housing 110 while the second guiding structures 520 can comprise guiding slots slidably connected to the guiding ribs correspondingly. Furthermore, each one of the first blocking members 113 abuts against each one of the second blocking members 302 correspondingly; therefore, the wire organization base 300 can be secured onto the wire connection base 110 and is able to slide along the axial direction of the insulative column housing 100. In addition, the piercing cutters 210 penetrate into the positioning holes 311 of the wire plug-in slots 310 correspondingly.

Please refer to FIG. 1 and FIG. 3. In this embodiment, the tubular outer casing 400 is a hollow tube made of a metal material. The tubular outer casing 400 comprises a first casing member 410 and a second casing member 420 attached each other by screw fastening. The first casing member 410 covers the connection plug head 120 and the connection plug head 120 is exposed on the rear end surface of the first casing member 410 in order to allow the another electrical connector to be plugged thereon correspondingly; the first casing member 410 includes a threaded portion 411 circumferencing an outer lateral surface thereof and arranged corresponding to the position of the connection plug head 120. The second casing member 420 covers the wire connection base 110 and the second casing member 420 includes a wire connection opening 421 formed at a rear end surface thereof. As shown in FIG. 1, the electrical connector of the present invention is provided for an electrical cable 10 to be plugged therein, and the electrical cable is constructed by a plurality of wires 11 bundled together; wherein each one of the wires 11 is electrically connected to each one of the terminals 200 correspondingly. In this embodiment of the present invention, the electrical connector uses an electrical cable 10 constructed by six wires 11 bundled together as an example for illustration, wherein the connection method is described in further details below. First, the first casing member 410 is detached from the second casing member 420, followed by plugging the electrical cable 10 into the second casing member 420 via the wire connection opening 421.

Figure 4:
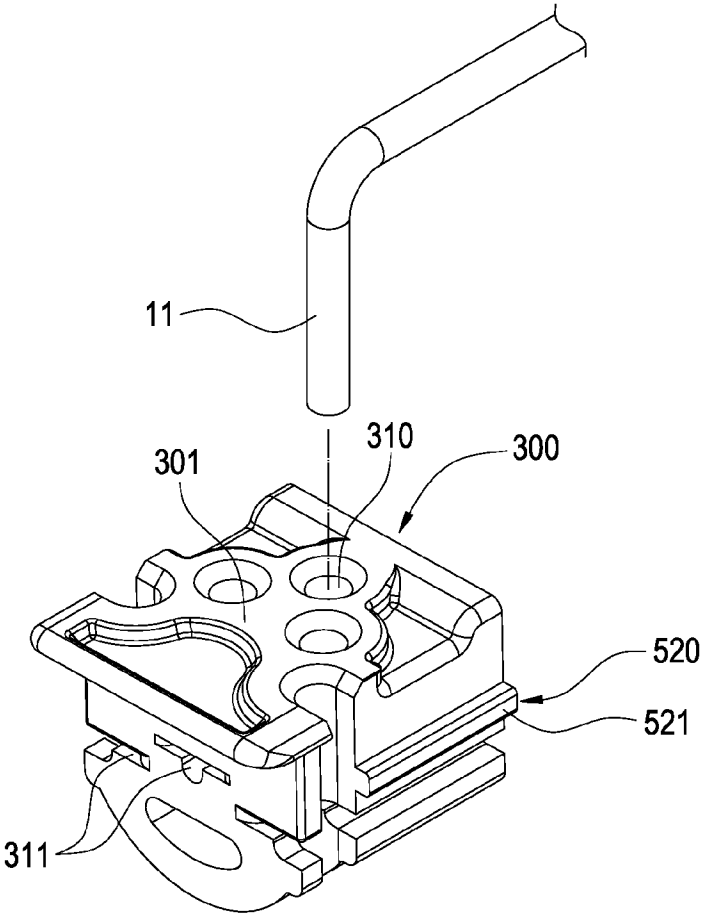
FIG. 4 is an illustration showing the wire organization base of the electrical connector according to a preferred embodiment of the present invention.
Figure 5:
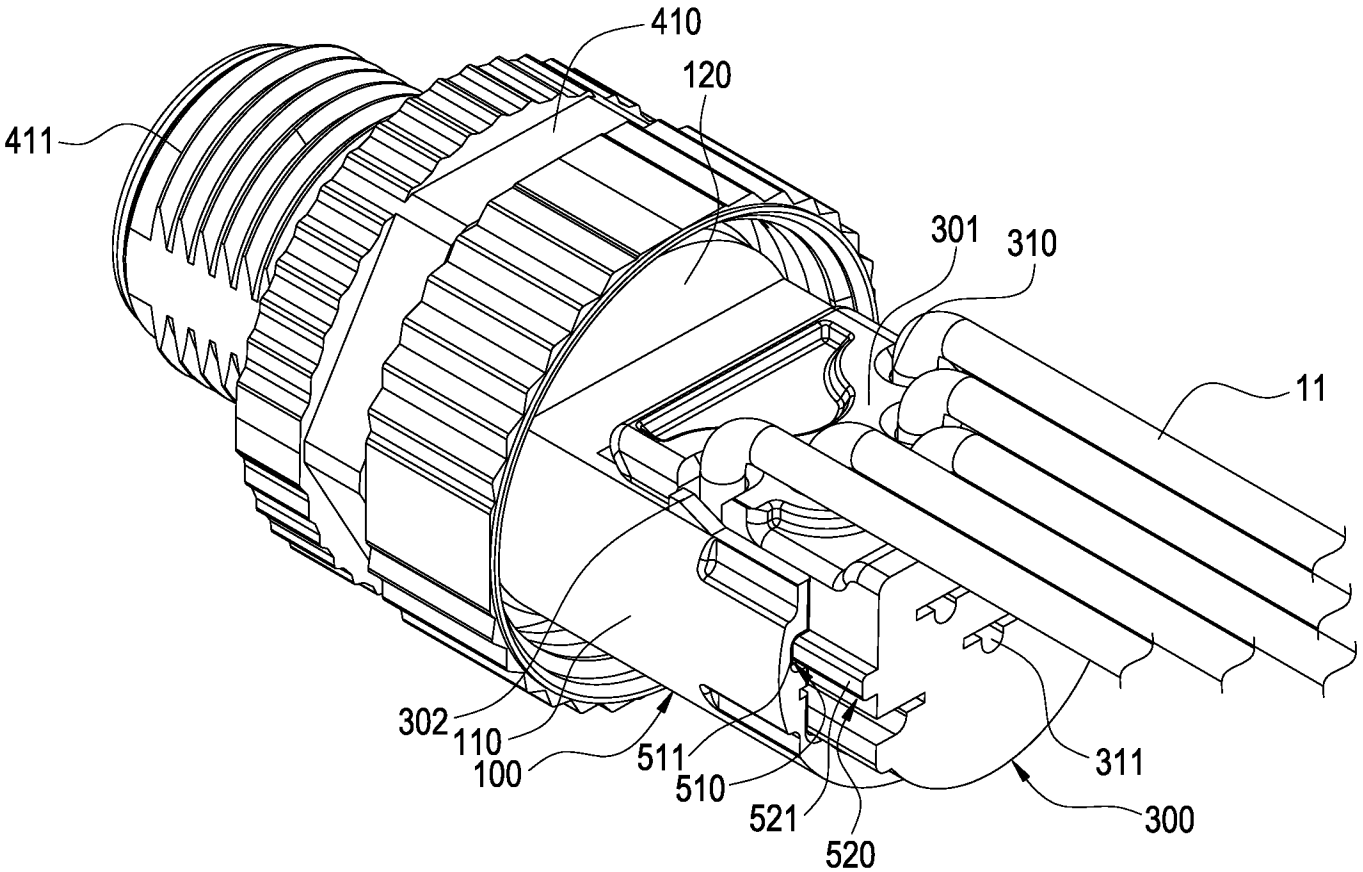
FIG. 5 is an illustration showing the plugging of the wires into the electrical connector according to a preferred embodiment of the present invention.
Figure 6:
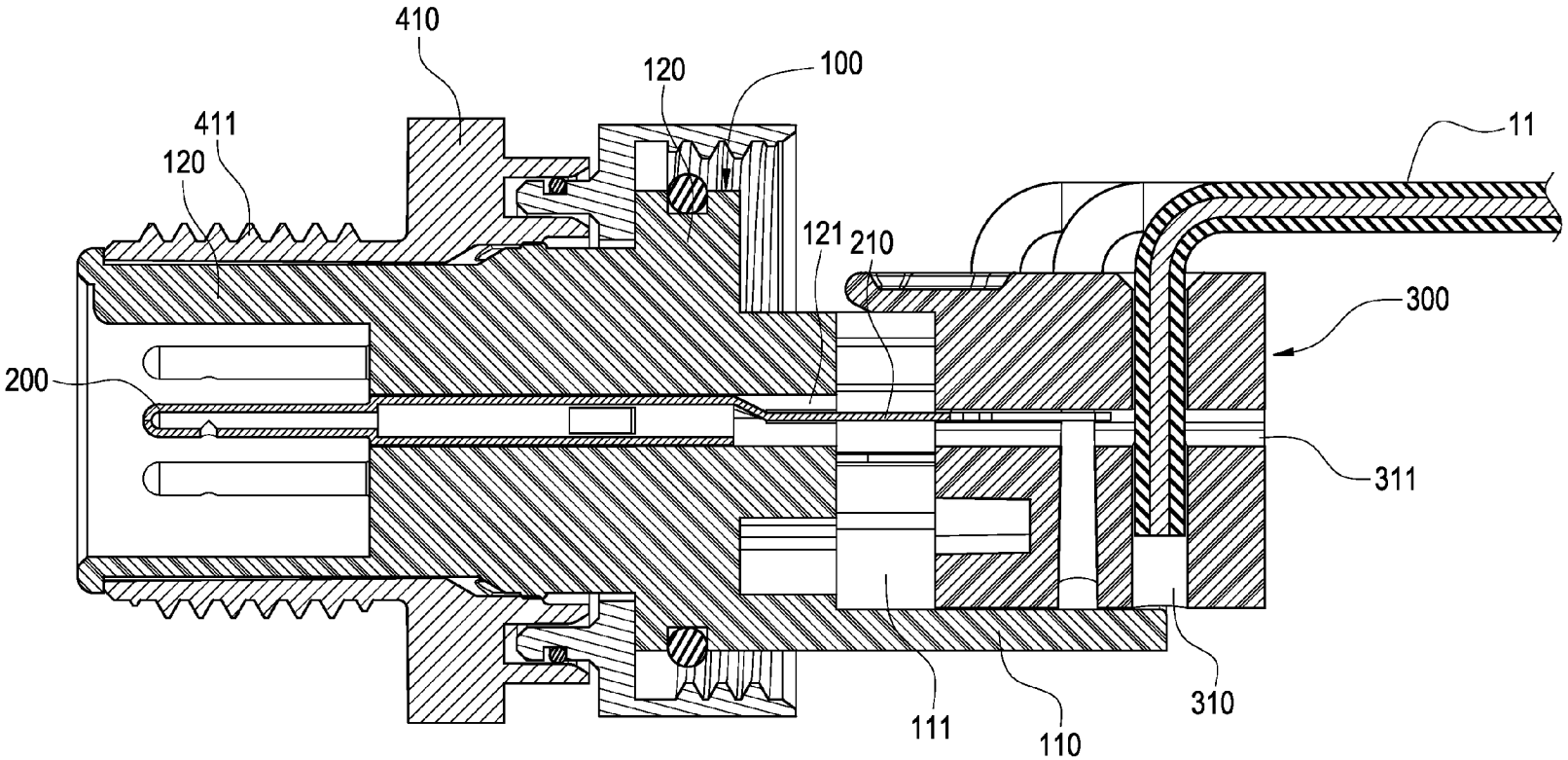
FIG. 6 is another illustration showing the plugging of the wires into the electrical connector according to a preferred embodiment of the present invention.
Figure 7:
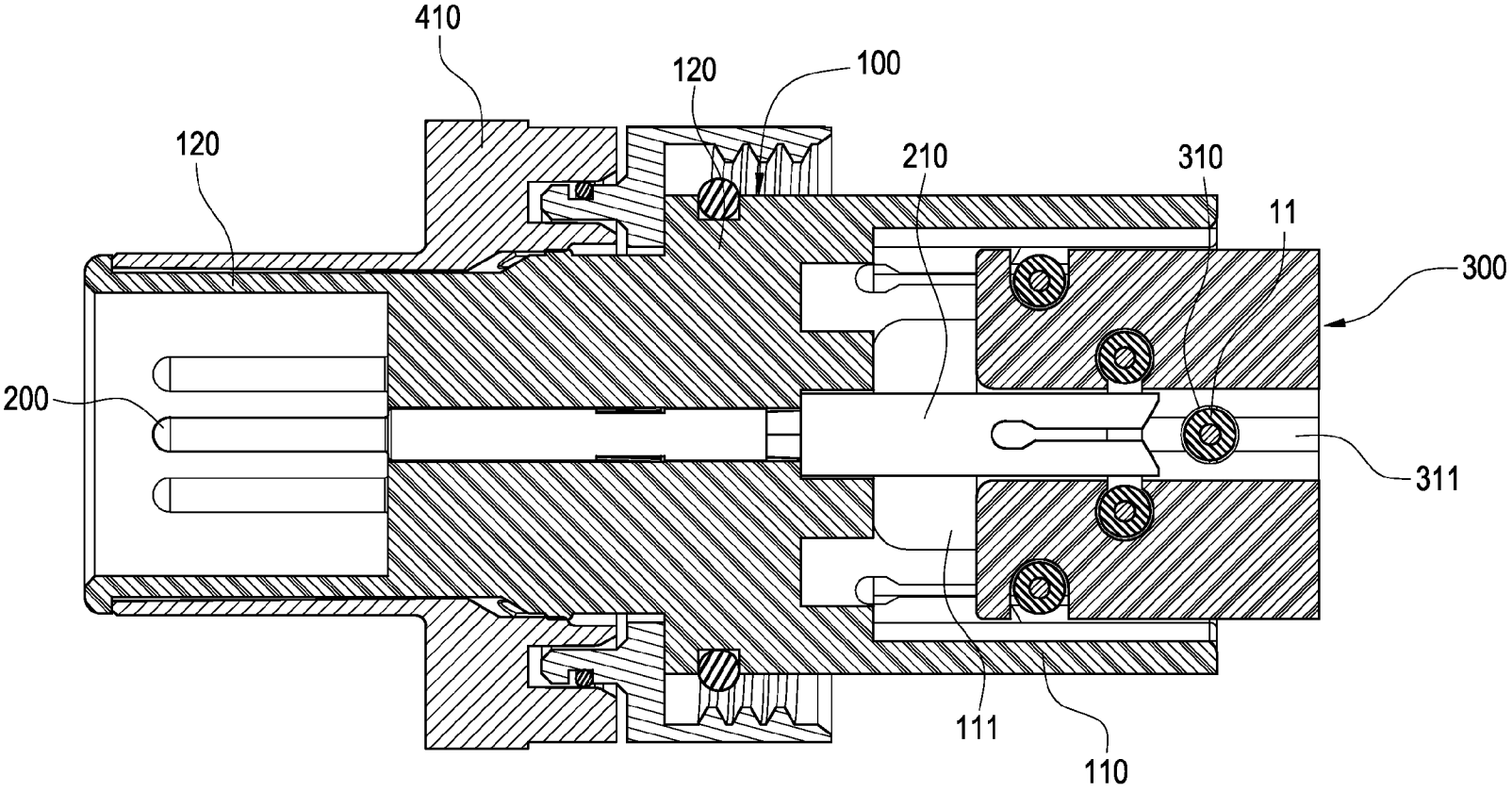
FIG. 7 is a cross sectional view of the electrical connector in FIG. 6.

Please refer to FIG. 4 to FIG. 6. The wire organization base 300 is retracted outward from the receiving slot 111 in order to allow the piercing cutters 210 to be retrieved from the corresponding wire plug-in slots 310. The rear end of each one of the wires 11 penetrates through each one the wire plug-in slots 310 via the wire plug-in surfaces 301 of the wire organization base 300 correspondingly such that the rear end of each one of the wires 11 is secured inside the wire organization base 300.

Figure 8:
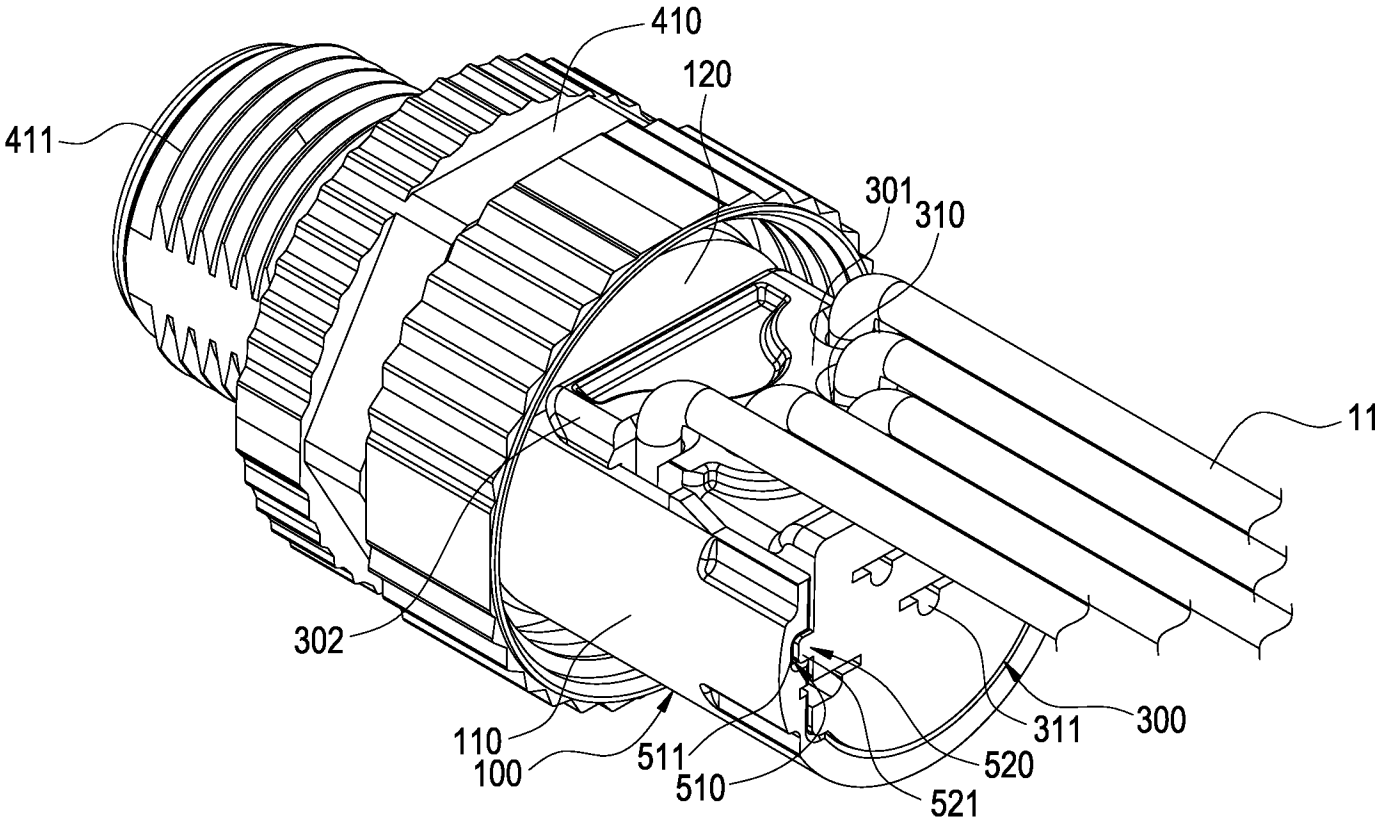
FIG. 8 is an illustration showing the connection of the wires on the electrical connector according to a preferred embodiment of the present invention.
Figure 9:
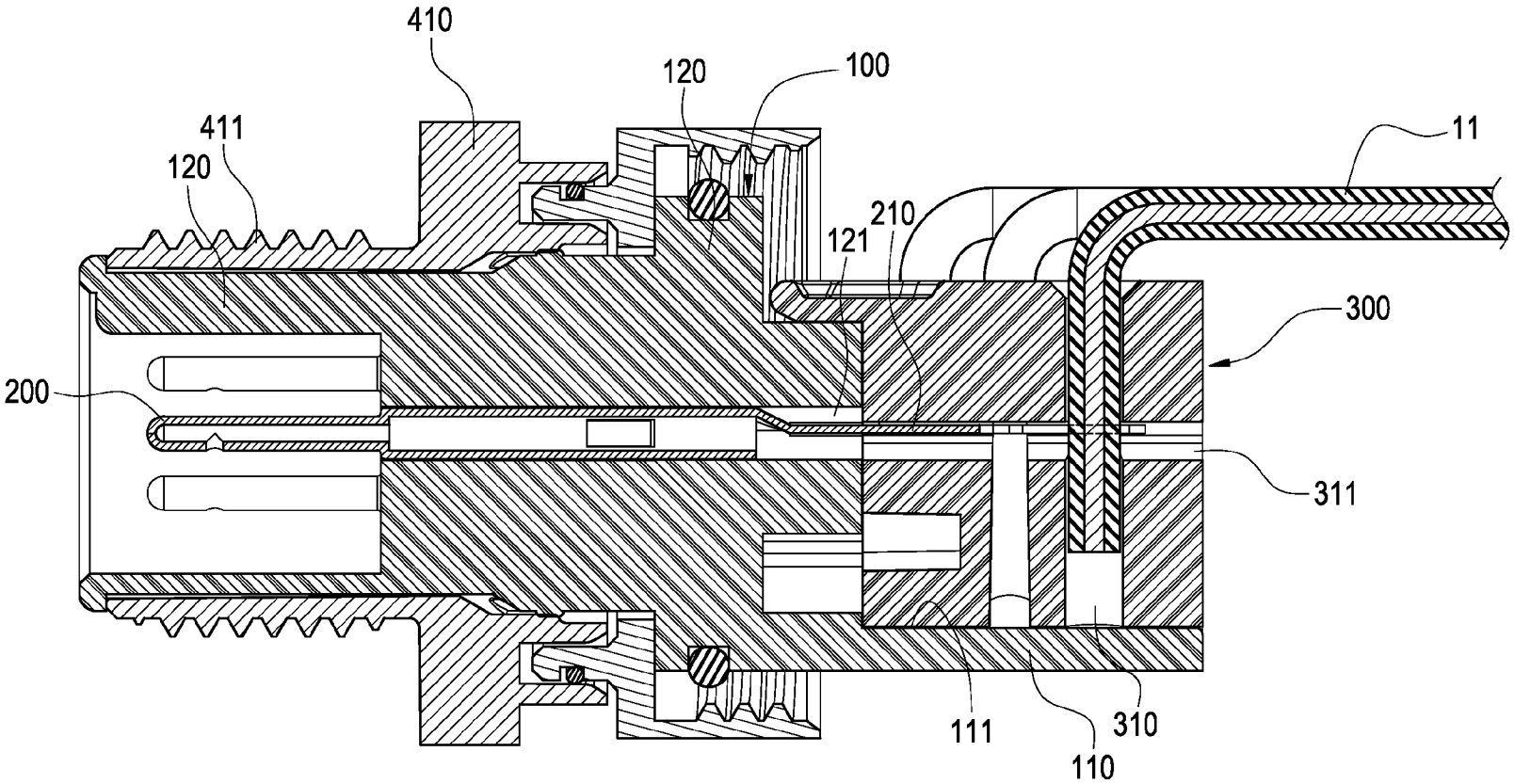
FIG. 9 is another illustration showing the connection of the wires on the electrical connector according to a preferred embodiment of the present invention.
Figure 10:
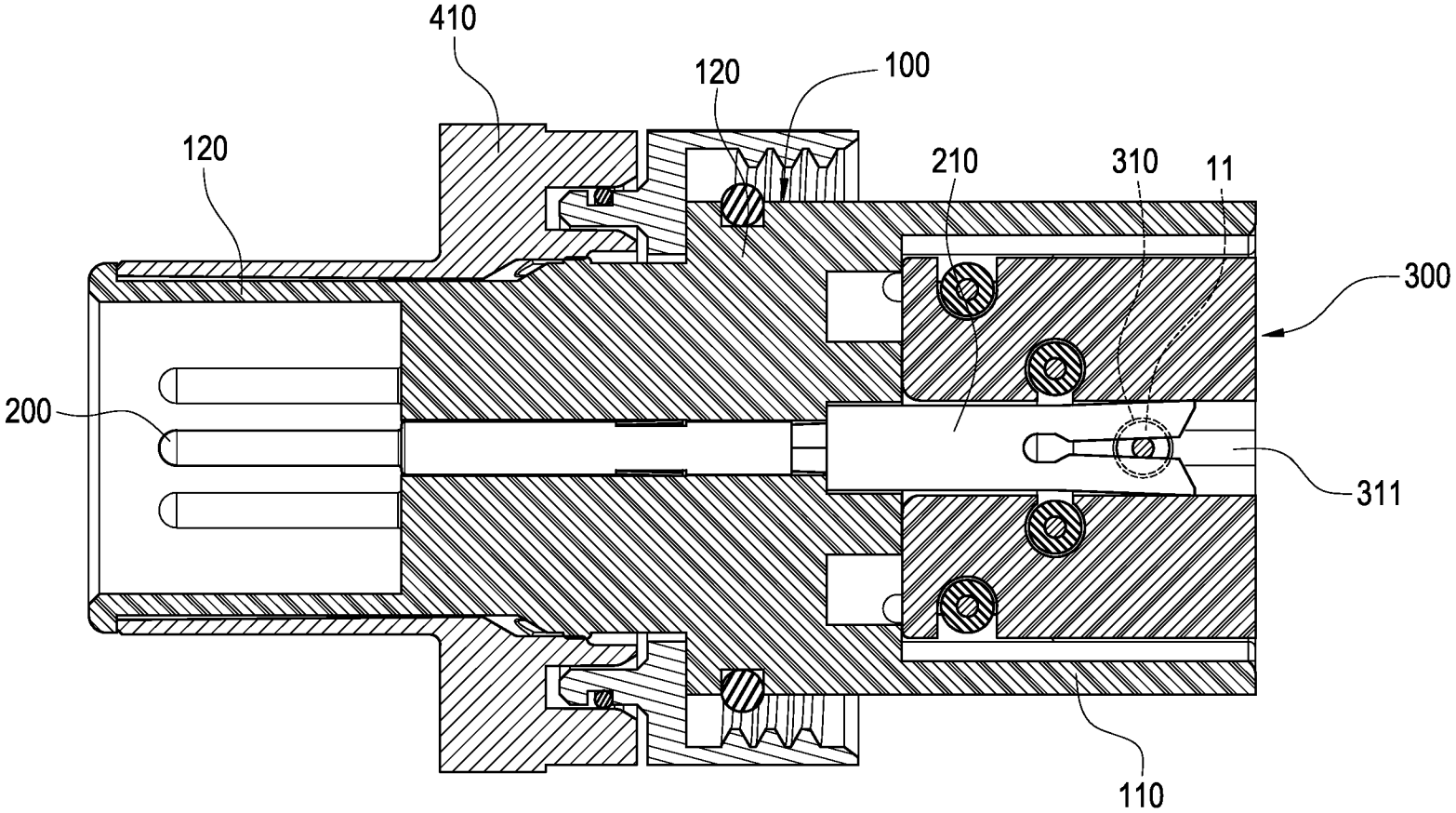
FIG. 10 is a cross sectional view of the electrical connector in FIG. 9.

Please refer to FIG. 8 to FIG. 10. The wire organization base 300 is pressed further to reach the bottom of the receiving slot 111 in order to allow the piercing cutters 210 to pass through the positioning holes 311 of the wire plug-in slots 310 correspondingly and to further penetrate through the corresponding wire plug-in slots 310. With such configuration, each one of the piercing cutters 210 is able to pierce through the outer skin of the corresponding wire 11 penetrating into the wire plug-in slot 310 as well as to clamp and hold the wire 11. Therefore, each one of the terminals 200 is electrically connected to the corresponding wire 11 via the piercing cutter 210, following which the first casing member 410 and the second casing member 420 are attached to each other via the method of screw fastening in order to achieve the wire connection thereof. In this embodiment, an operator can examine the wires clamped by the wire organization base 300 via the wire plug-in surfaces 301. Accordingly, the operator can easily view and examine the connections among the wires 11 and the terminals 200 based on the different colors of the wires 11 configured in the electrical cable 10.

The electrical connector of the present invention utilizes the wire organization base 300 for clamping and securing the wires 11 thereon, which is then further pressed into the wire connection base 100; therefore, the wires 11 can be electrically connected to the corresponding terminals 200 with ease.

The above provides a detail description of the preferred embodiments of the present invention for illustrative purposes only, which shall not be treated as limitations of the present invention. Any equivalent modification without deviating from the spirit of the present invention shall be deemed to be within the scope of the present invention.

What is claimed is:

1. An electrical connector comprising:

an insulative column housing (100); the insulative column housing having a wire connection base (110) provided at one end thereof; an end portion of the wire connection base (110) having a receiving slot (111) formed thereon along an axial direction of the insulative column housing (100);

a plurality of terminals (200) embedded inside the insulative column housing (100); each one of the plurality of terminals (200) having a piercing cutter (210) provided at one end thereof; the piercing cutter (210) extended along the axial direction of the insulative column housing (100) and penetrating into the receiving slot (111); and a wire organization base (300) penetrating into the receiving slot (111) along the axial direction of the insulative column housing (100); the wire organization base (300) having a plurality of wire plug-in slots (310) corresponding to the plurality of piercing cutters (210) respectively; each one of the plurality of wire plug-in slots (310) and the plurality of piercing cutters (210) corresponding thereto arranged to be perpendicular with each other, wherein the wire connection base (110) includes an opening (112) formed on one side thereof and connected to the receiving slot (111); the wire organization base (300) includes a wire plug-in surface (301) provided to allow one end of each one of the wire plug-in slots (310) to connect to the wire plug-in surface (301) such that the wire plug-in surface (301) passes through the opening (112) to be exposed on the wire connection base (110).

2. The electrical connector according to claim 1, wherein each one of the plurality of wire plug-in slots includes a positioning hole (311) provided to allow the corresponding piercing cutter (210) to penetrate therethrough.

3. The electrical connector according to claim 1, wherein the receiving slot (111) includes a pair of first guiding structures (510) arranged opposite from each other at an inner wall thereof; the wire organization base (300) includes a pair of second guiding structures (520) arranged opposite from each other at an outer wall thereof and corresponding to the pair of first guiding structures (510) respectively; the pair of first guiding structures (510) are slidably connected to the pair of second guiding structures (520) respectively.

4. The electrical connector according to claim 3, wherein each one of the pair of first guiding structures (510) comprises a guiding track (511) indented into the inner wall of the receiving slot (111) and extended along the axial direction of the insulative column housing (100); each one of the pair of second guiding structures (520) comprises a guiding rib (521) correspondingly and slidably connected to the guiding track (511).

5. The electrical connector according to claim 3, wherein each one of the pair of first guiding structures (510) comprises a guiding rib protruding from the inner wall of the receiving slot (111) and extended along the axial direction of the insulative column housing (100); each one of the pair of second guiding structures (520) comprises a guiding track correspondingly and slidably connected to the guiding rib.

6. The electrical connector according to claim 1, wherein the insulative column housing (100) includes a connection plug head (120) formed on another end thereof; the connection plug head (120) includes a plurality of perforations (121) formed at the axial direction thereof and corresponding to the plurality of terminals (200); each one of the plurality of terminals (200) penetrates into each one of the plurality of perforations (121) correspondingly with another end thereof.

7. The electrical connector according to claim 1, further comprising a tubular outer casing (400) covering the insulative column housing (100); the tubular outer casing (400) includes a threaded portion (411) circumferencing an outer lateral surface on one end thereof and corresponding to a position of the connection plug head.

8. The electrical connector according to claim 7, wherein the tubular outer casing (400) comprises a first casing member (410) and a second casing member (420) attached to each other along an axial direction thereof; the first casing member (410) covers the connection plug head (120) and the second casing member (420) covers the wire connection base (110).

9. The electrical connector according to claim 8, wherein the threaded portion (411) is provided at an outer lateral surface of the first casing member (410).

10. The electrical connector according to claim 8, wherein second casing member (420) includes a wire connection opening (421) formed thereon.

* * * * *